US005505650A

United States Patent [19]

Harned

[11] Patent Number: 5,505,650

[45] Date of Patent: Apr. 9, 1996

[54] MAPLE-SEED SIMULATING AUTO-ROTATING TOY AND ASSOCIATED GAME

[76] Inventor: William D. Harned, 7537 Scenic View Dr., Knoxville, Tenn. 37938

[21] Appl. No.: 353,057

[22] Filed: Dec. 9, 1994

[51] Int. Cl.[6] ..... A63H 27/127

[52] U.S. Cl. ..... 446/36; 273/428

[58] Field of Search ..... 446/34, 36–48; 273/426–428

[56] References Cited

U.S. PATENT DOCUMENTS

| | | | |
|---|---|---|---|
| D. 84,029 | 4/1931 | Ditlevsen . | |
| 913,381 | 2/1909 | Hay | 273/428 X |
| 1,110,738 | 9/1914 | Berecz . | |
| 4,183,168 | 1/1980 | Ross . | |
| 4,309,038 | 1/1982 | Spoon . | |
| 4,904,219 | 2/1990 | Cox . | |
| 5,173,069 | 12/1992 | Litos et al. | 446/36 |
| 5,284,454 | 2/1994 | Randolph . | |

FOREIGN PATENT DOCUMENTS

| | | | |
|---|---|---|---|
| 9009829 | 9/1990 | European Pat. Off. | 273/428 |
| 793980 | 2/1936 | France | 446/36 |
| 1021256 | 2/1953 | France | 446/36 |
| 2093710 | 9/1982 | United Kingdom | 446/34 |

*Primary Examiner*—Robert A. Hafer
*Assistant Examiner*—D. Neal Muir
*Attorney, Agent, or Firm*—Pitts & Brittian

[57] ABSTRACT

A maple-seed simulating autorotating flyer. The flyer is provided with a spherical shock absorbing nose section and a wing section having a substantially straight leading edge, a curved tail, a spine conformed to said leading edge and tail and a curved trailing edge. The wing is constructed of a substantially planar sheet of a lightweight, semi-rigid fabric of uniform thickness. The weight of the nose, the length and width of the wing are configured so as to impart aerodynamic characteristics to the flyer such that when thrown upward, the flyer will autorotate during descent. The flyer is used in accordance with the method of the present invention, wherein the maple-seed simulating autorotator is thrown upward from a designated throwing area. A plurality of scoring targets, each having a designated point value, are randomly positioned around the throwing area. The thrower is awarded the number of points assigned to the scoring target that is hit by, or closest to, the autorotating flyer upon landing.

12 Claims, 3 Drawing Sheets

MAPLE-SEED SIMULATING AUTO-ROTATING TOY AND ASSOCIATED GAME

TECHNICAL FIELD

This invention relates to the field of hand-held, hand-launched flying toys. More specifically, it relates to a single-winged autorotator and an associated throwing game.

BACKGROUND ART

Many spinning, hand-launched, flying toys have been disclosed in the prior art. For instance, U.S. Pat. No. 1,110,738, issued to Berecz on Sep. 15, 1914, discloses a flying and spinning toy in the manner of a spinning top with an aerial propeller whereby the top first spins in a flying movement through the air and continues to spin on the ground upon landing.

U.S. Pat. No. Des. 84,029, issued to J. C. Ditlevsen on Apr. 28, 1931, discloses the ornamental design for a flying top.

U.S. Pat. No. 4,183,168, issued to Roger E. Ross on Jan. 15, 1980, discloses a flying disk toy having a crank for providing rotational acceleration.

U.S. Pat. No. 4,309,038, issued to Donald M. Spoon on Jan. 5, 1982, discloses a throw toy having spoke-like graspable members which extend from a central hub.

U.S. Pat. No. 4,904,219, issued to Glenn M. Cox on Feb. 27, 1990, discloses an autorotating hand flyer that is of a specific one piece construction. Cox's hand flyer has a tapered wing and a substantially pointed front end and an arcuate cut out on the root at the trailing edge of the flyer. Both the leading and trailing edge of Cox's flyer are substantially convex. Further, Cox's flyer has a pointed tail.

U.S. Pat. No. 5,173,069, issued to Mark A. Litos on Dec. 22, 1992, also discloses an autorotative flyer having a concave leading edge and a convex trailing edge which is provided with specifically configured scallops. Litos's wing, wing spar and root are integrally formed. Moreover, Litos teaches a specific tapering of the wing from leading to trailing edge. Further, Litos teaches that the thickness and rearward extension of the spar diminishes from the root to the wing tip. This specific tapering of both the wing and the spar results in increased manufacturing costs.

U.S. Pat. No. 5,284,454, issued to George B. Randolph on Feb. 8, 1994, discloses a toy helicopter which is capable of a projected nose up ascent and a helicopter nose down descent.

None of the cited autorotating flyers closely simulates the wing configuration of the autorotating maple-seed. Nor do the cited autorotating flyers have a spherical, resilient nose that is lightweight, yet has a shock absorbing capability to prevent damage or deformation of the nose upon impact.

Accordingly, it is an object of this invention to provide an autorotating flyer toy that has a wing configuration that closely simulates the wing configuration of the autorotating maple seed.

It is a further object of this invention to provide an autorotating flyer that has a spherical nose.

Still another object of the present invention is to an autorotating flyer that has a spherical nose that is lightweight, yet has a shock absorbing capability to prevent damage or deformation of the nose upon impact.

Yet a further object of the present invention is to provide a novel game of toss to be played with the maple-seed simulating autorotating flyer.

Other objects and advantages over the prior art will become apparent to those skilled in the art upon reading the detailed description together with the drawings as described as follows.

DISCLOSURE OF THE INVENTION

In accordance with the various features of this invention, a maple-seed simulating autorotating flyer is provided. The flyer is provided with a spherical shock absorbing nose section and a wing section having a substantially straight leading edge, a curved tail, a spine conformed to said leading edge and tail and a curved trailing edge. The wing is constructed of a planar sheet of a lightweight, semi-rigid fabric of uniform thickness. The weight of the nose, the length and width of the wing are configured so as to impart aerodynamic characteristics to the flyer such that when thrown upward, the flyer will autorotate during descent.

A method of playing a novel game with the flyer is also provided. In accordance with the method of the present invention, the maple-seed simulating autorotator is thrown upward from a designated throwing area. A plurality of scoring targets, each having a designated point value, are randomly positioned around the throwing area. The thrower is awarded the number of points assigned to the scoring target that is hit by, or closest to, the autorotating flyer upon landing.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
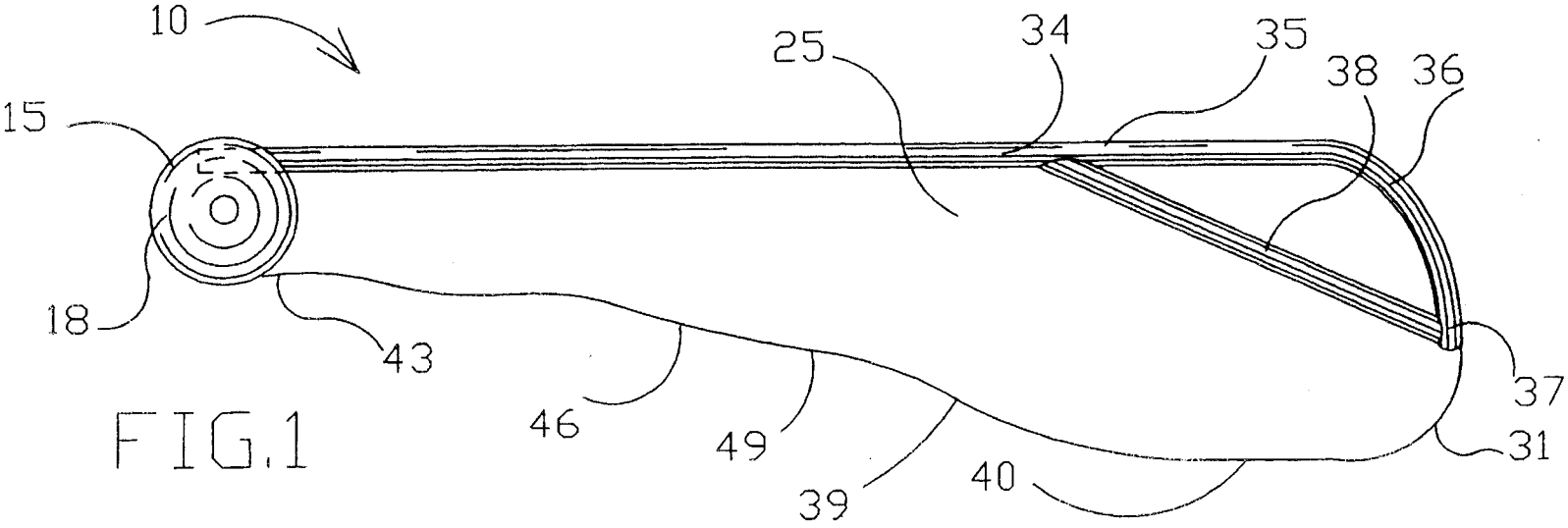
FIG. 1 illustrates a top plan view of the autorotator of the present invention.
Figure 2:
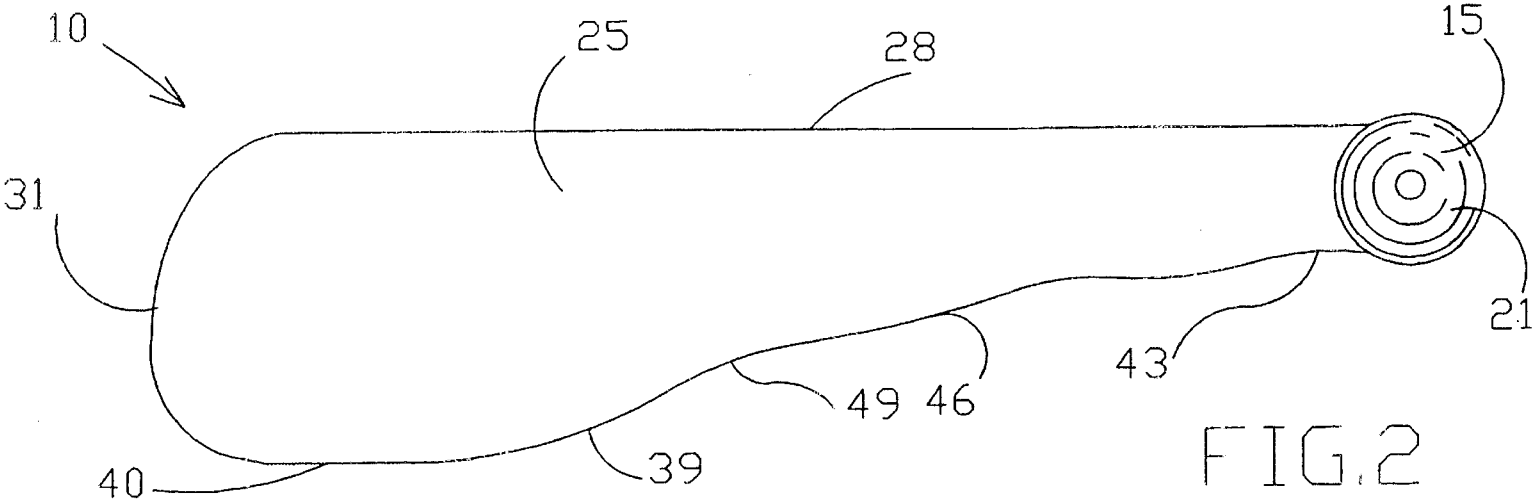
FIG. 2 illustrates a bottom plan view of the autorotator seen in FIG. 1.
Figure 3:
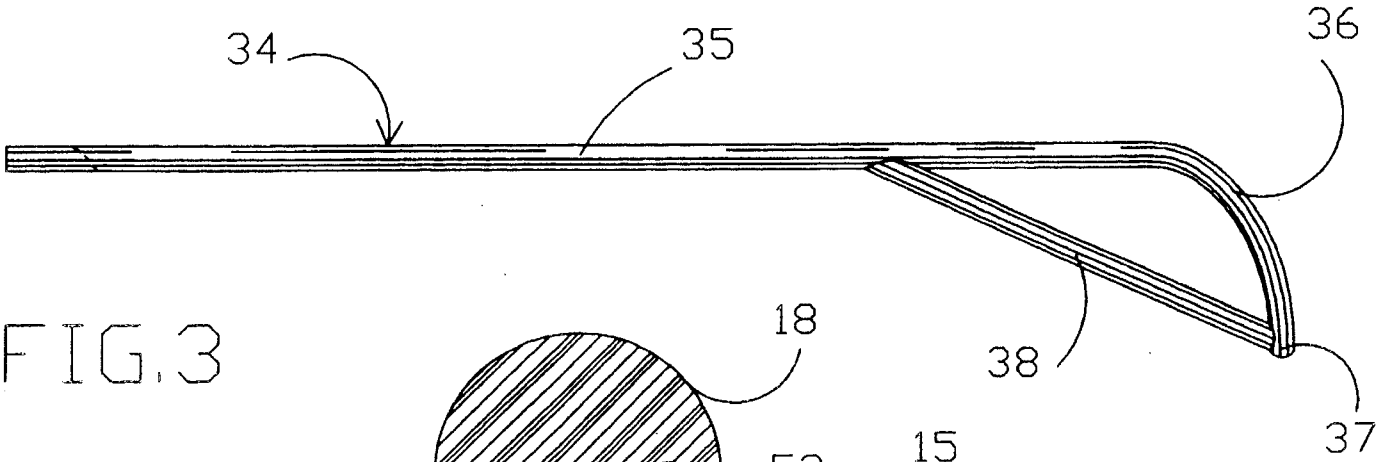
FIG. 3 illustrates a plan view of the wing brace of the autorotator of the present invention.
Figure 4:
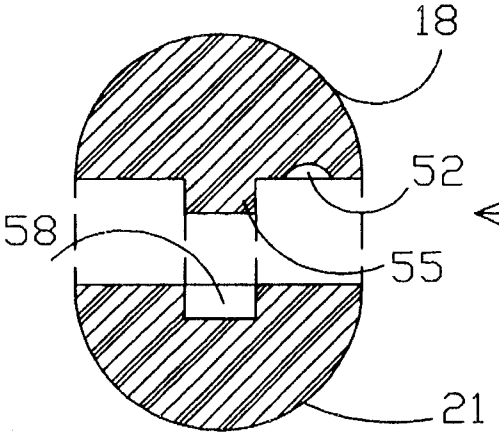
FIG. 4 illustrates a cross sectional view of the nose member of the autorotator of the present invention.
Figure 5:
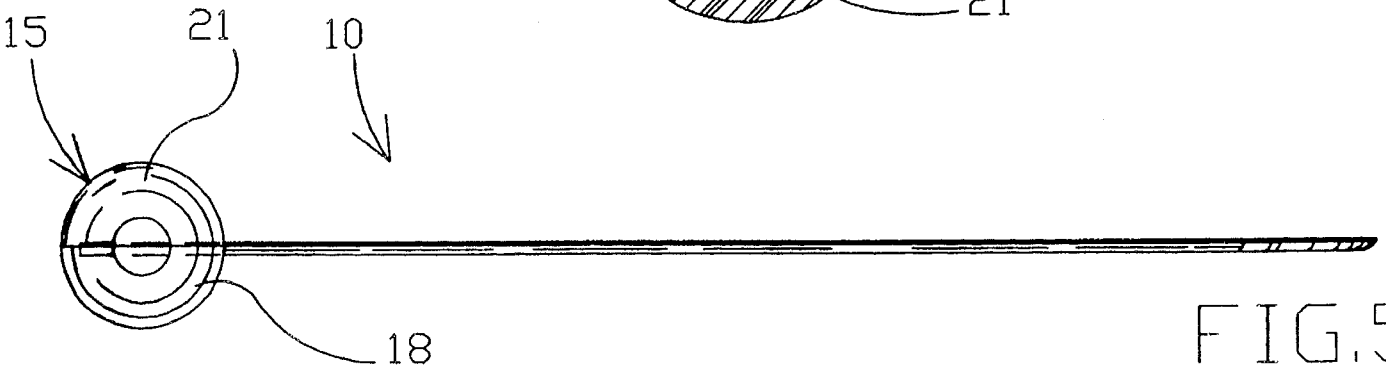
FIG. 5 illustrates a side view of the autorotator of the present invention.

A maple-seed simulating autorotating flyer, constructed in accordance with the present invention, is illustrated generally as 10 in the Figures. Autorotating flyer 10 has an overall length in the range of about 200 mm to about 365 mm and has an overall weight in the range of about 11.5 grams ("g") to about 26 g. Autorotating flyer 10 is provided with a substantially spherical nose section 15. Nose section 15 is comprised of a substantially spherical member that is split into an upper hemisphere 18 and a lower hemisphere 21. Nose section 15 is constructed of a substantially resilient material that is shock absorbent such as, though not limited to, rubber. In the preferred embodiment, nose 15 weighs in the range of about 8.5 g to about 13.9 g.

Wing section 25 has a substantially straight leading edge 28, a curved tail 31, a spine 34 conformed to leading edge 28 and tail 31 and a curved trailing edge 39. Spine 34 has a substantially straight segment 35, disposed along leading edge 28, a curved segment 36 disposed along tail 31 and a distal end 37. A brace 38 is disposed on spine 34 from a position on straight segment 35 proximal to curved segment 36 extending therefrom to distal end 37 providing a graspable member. Trailing edge 39 has a compound curve consisting of at least one substantially convex region 40 proximate tail 31 and at least one substantially concave region 43. In the preferred embodiment, a substantially convex region 46 is disposed between concave region 43 and a second concave region 49. In the preferred embodiment, convex region 40 defines the longest chord of wing 25 while concave region 43 defines the shortest chord of wing 25. Wing 25 is constructed of a substantially planar sheet of a lightweight, semi-rigid fabric of uniform thickness. It will be understood that wing 25 could also be constructed of a planar sheet of plastic of uniform thickness and that the present invention is not limited to these materials. Wing 25 weighs in the range of about 1.0 g to about 2.2 g. Spine 34 and brace 38 weigh in the range of about 1.8 g to about 7.9 g. The weight of nose 15, wing 25, including spine 34 and brace 38 and the length and width of wing 25 are configured so as to impart aerodynamic characteristics, which are known in the art, to the flyer such that when thrown upward, the flyer will autorotate during descent. Although specific ranges of weights and dimensions are disclosed, it will be understood that the present invention is not limited to these weights and dimensions.

The proximal end of wing 25 is disposed between upper hemisphere 18 and lower hemisphere 21. In the illustrated embodiment, the proximal end of spine 34 is received in a groove 52 in one of the hemispheres, preferably upper hemisphere 18 such that the proximal end of spine 34 is also disposed between upper hemisphere 18 and lower hemisphere 21. Upper hemisphere 18 and lower hemisphere 21 are securely joined together with an adhesive, preferably an epoxy. In order to prevent axial twisting between upper hemisphere 18 and lower hemisphere 21, a locking tab 55 is disposed on upper hemisphere 18. Locking tab 55 registers with and is received by notch 58 in lower hemisphere 21. Of course, other conventional methods of securing wing 25 to the upper and lower hemispheres 18, 21 may be used as well. That method disclosed herein is for illustration purposes only and is not intended to limit the present invention.

A method of playing a novel game with maple-seed simulating autorotating flyer 10 is also provided. In accordance with the simplest embodiment of the method of the present invention, autorotating flyer 10 is thrown upward from designated throwing area 70. A plurality of scoring targets 75, each having a designated point value, preferably printed on the face of scoring target 75, are randomly positioned around throwing area 70. In the illustrated embodiment, twenty scoring targets 75 are provided with point designations as set out in the table below:

| Assigned Point Value | Number of Scoring Targets |
|---|---|
| 0 | 6 |
| 20 | 9 |
| 30 | 3 |
| 50 | 2 |

Figure 6:
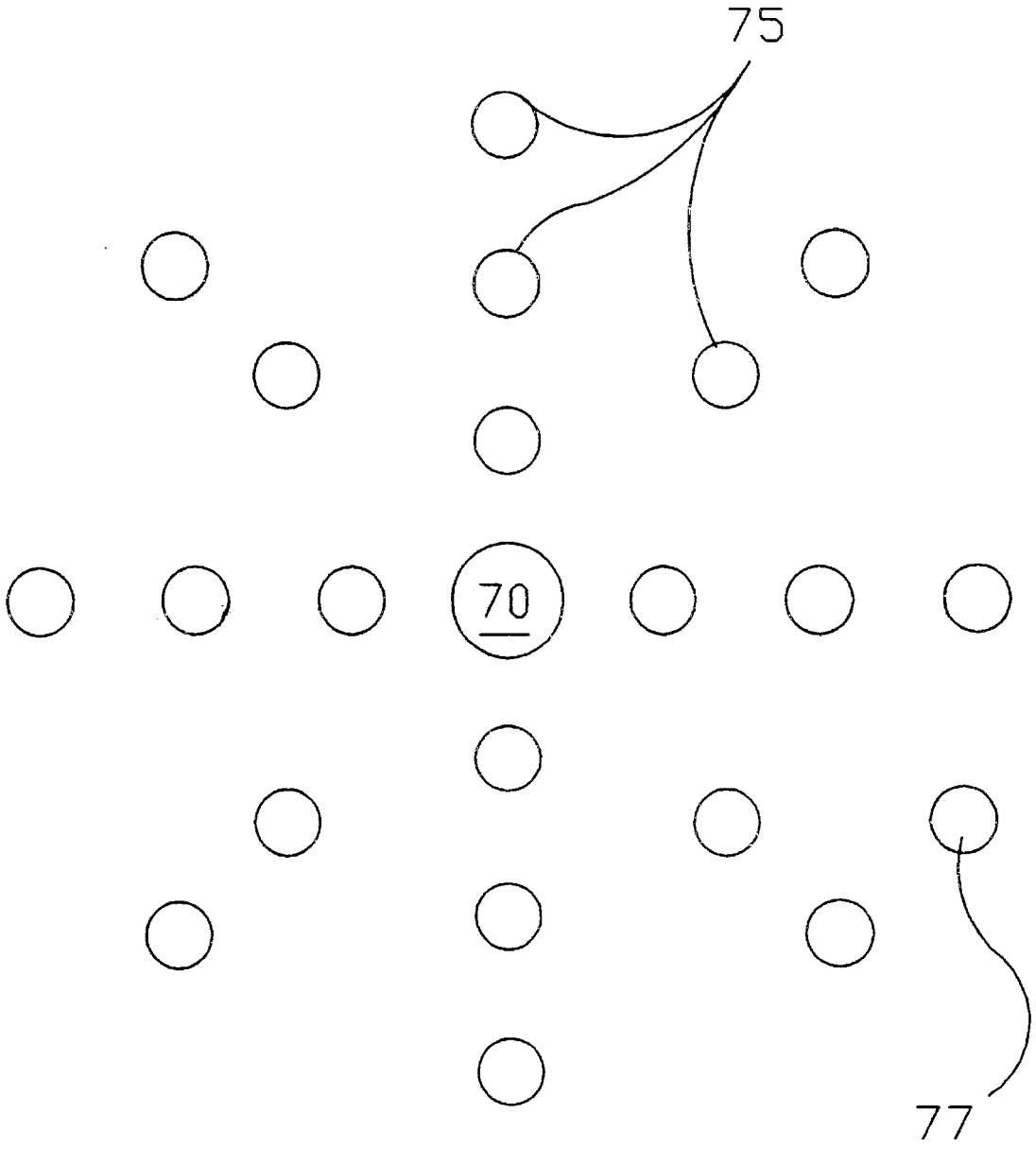
FIG. 6 illustrates a plan view of the preferred embodiment of the playing area for the disclosed method.

The thrower is awarded the number of points assigned the scoring target 75 that is in closest proximity to, i.e. hit by, or closest to, autorotating flyer 10 upon landing. In this fashion, a round of play between a plurality of players is commenced by shuffling the plurality, such as the twenty as set forth above, of scoring targets 75 and randomly placing scoring targets 75 face down, i.e. point side down, around throwing area 70. The scoring targets 75 are apart from each other and from the throwing area 70, as in the arrangement illustrated in FIG. 6.

The first player steps into throwing area 70 without disturbing scoring targets 75. With autorotating flyer 10 in hand, player rapidly turns around in throwing area 70 three to four times. Upon completing three to four revolutions, the player throws autorotating flyer 10 upward without stepping on the circumference of throwing area 70. If the player steps on or beyond the circumference of throwing area 70, the throw is disqualified and no points are awarded. Upon completion of a valid throw, scoring target 75 that is hit by, or is closest to, autorotating flyer 10 is turned over and the player is awarded the points assigned to the scoring target 75. This scoring target is then removed from the playing field. A further bonus scoring target 77 can be provided which doubles a players points. In one method of play, the player with the most points when all of the scoring targets are removed from the playing field is declared the winner. In an alternate method of play, the first player to be awarded one-hundred points is declared the winner. In still a further method of play, the player with the fewest points when one of the players reaches one-hundred points is declared the winner. In a method where a low score is desirable, the player is penalized by the addition of a determined amount to his score if he steps out of the throwing area during the throw.

From the foregoing description, it will be recognized by those skilled in the art that an autorotating flyer offering advantages over the prior art has been provided. Specifically, the autorotating flyer has a wing configuration that closely simulates the wing configuration of the autorotating maple-seed. Further, to prevent damage upon impact, the autorotating flyer has a spherical, shock absorbing nose. Yet further a novel game of toss to be played with the maple-seed simulating autorotating flyer is also provided.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. An autorotating flying toy comprising:

a substantially spherical nose member defining upper and lower hemispheres;

a wing member having a substantially straight leading edge, a curved tail a planar sheet with curved trailing edge attached to said leading edge, and a proximal end disposed between said nose member upper hemisphere and said nose member lower hemisphere; and a spine carried by said wing member defining said leading edge and said curved tail, said spine having a straight segment from a proximal end received within a groove defined by said upper hemisphere of said substantially spherical nose member to a curved segment integrally formed with said straight segment, and terminating at a distal end, said spine being a single continuous width from said proximal end to said distal end.

2. The autorotating flying toy of claim 1 wherein said autorotating flying toy further comprises a brace disposed on said spine from a position on straight segment proximal to said curved segment extending therefrom to distal end thereby providing a graspable member.

3. The autorotating flying toy of claim 1 wherein said trailing edge has a compound curve consisting of a first substantially convex region and a first substantially concave region, said first convex region proximate said tail, wherein said first convex region defines a longest chord of said wing and said first concave region defines a shortest chord of said wing.

4. The autorotating flying toy of claim 3 wherein a second substantially convex region is disposed between said first concave region and a second concave region.

5. The autorotating flying toy of claim 1 wherein said nose member is constructed of a substantially shock absorbent, resilient material.

6. The autorotating flying toy of claim 1 wherein said wing is constructed of a substantially planar sheet of a lightweight, semi-rigid material of uniform thickness.

7. The autorotating flying toy of claim 1 wherein said upper and lower hemispheres are securely joined together with an adhesive.

8. An autorotating flying toy comprising:

a substantially spherical nose member defining upper and lower hemispheres, wherein said nose member is constructed of a substantially shock absorbent, resilient material;

a wing member having a substantially straight leading edge, a curved tail a planar sheet with curved trailing edge attached to said leading edge, and a proximal end disposed between said upper hemisphere and said lower hemisphere, wherein said curved trailing edge has a compound curve consisting of a first substantially convex region and a first substantially concave region, said first convex region proximate said tail, wherein said first convex region defines the longest chord of said wing and said first concave region defines the shortest chord of said wing, wherein said wing is constructed with said planar sheet being a lightweight, semi-rigid fabric of a uniform thickness;

a spine carried by said wing member defining said leading edge and said curved tail, said spine having a straight segment from a proximal end received within a groove defined by said upper hemisphere of said substantially spherical nose member to a curved segment integrally formed with said straight segment, and terminating at a distal end, said spine being a single continuous width from said proximal end to said distal end; and a brace disposed on said spine tom a position on said straight segment proximal to said curved segment extending therefrom to said distal end thereby providing a graspable member.

9. The autorotating flying toy of claim 8 wherein a second substantially convex region is disposed between said first concave region and a second concave region.

10. The autorotating flying toy of claim 8 wherein said autorotating flyer has an overall length in the range of about 100 mm to about 365 mm and has an overall weight in the range of about 11.5 g to about 26 g.

11. The autorotating flying toy of claim 8 wherein said nose member weighs in the range of about 8.5 g to about 13.9 g; wherein said wing weighs in the range of about 1.0 g to about 2.2 g; and wherein said spine and said brace collectively weigh in the range of about 1.8 g to about 7.9 g.

12. The autorotating flying toy of claim 8 wherein said upper and lower hemispheres are securely joined together with an adhesive.

* * * * *